US005507672A

United States Patent [19]

Imaeda

[11] Patent Number: 5,507,672

[45] Date of Patent: Apr. 16, 1996

[54] TRIM ADJUST SYSTEM FOR A WATERCRAFT

[75] Inventor: Hirofumi Imaeda, Iwata, Japan

[73] Assignee: Yamaha Hatsudoki Kabushiki Kaisha, Iwata, Japan

[21] Appl. No.: 353,192

[22] Filed: Dec. 9, 1994

[30] Foreign Application Priority Data

Dec. 9, 1993 [JP] Japan ..... 5-309488
Dec. 13, 1993 [JP] Japan ..... 5-311934

[51] Int. Cl.[6] ..... B63H 11/113

[52] U.S. Cl. ..... 440/1; 440/2; 440/40; 440/42

[58] Field of Search ..... 114/270; 440/40, 440/42, 1, 2

[56] References Cited

U.S. PATENT DOCUMENTS

| | | | |
|---|---|---|---|
| 3,834,345 | 9/1974 | Hager et al. | 440/57 |
| 3,906,885 | 9/1975 | Woodfill | 440/42 |
| 4,051,801 | 10/1977 | Woodfill et al. | 440/42 |
| 4,931,025 | 6/1990 | Torigai et al. | 440/1 |

*Primary Examiner*—Sherman Basinger
*Attorney, Agent, or Firm*—Knobbe, Martens, Olson & Bear

[57] ABSTRACT

A jet propelled watercraft having a discharge nozzle that can be adjusted for trim and an electrically operated trim condition indicator is provided for giving the rider the indication of the actual trim condition of the watercraft. In addition, an automatic trim control mechanism is provided that permits the operator to set the desired trim at varying watercraft speeds and the trim will be automatically set when those speeds are reached.

18 Claims, 8 Drawing Sheets

TRIM ADJUST SYSTEM FOR A WATERCRAFT

BACKGROUND OF THE INVENTION

This invention relates to a trim adjust system for a watercraft and more particularly to an improved automatic trim adjustment and indicating system for a jet-propelled type of watercraft.

A popular type of propulsion system for watercraft, particularly small watercraft of the type known as personal watercraft, is a jet propulsion unit. These jet propulsion units are driven by a wide variety of prime movers and include a jet pump having an impeller that draws water through a water inlet opening and discharges it rearwardly through a discharge opening for providing a propulsion force for the watercraft. Frequently there is associated with the discharge nozzle a pivotally supported steering nozzle that pivots about a vertically extending axis for steering of the watercraft. In addition to this, it has also been proposed to provide a nozzle that is pivotal about a horizontally disposed axis so as to change the angle relative to the horizontal at which the water is discharged. By adjusting about this horizontal axis, the trim of the watercraft may be adjusted. Various mechanical and power-operated arrangements have been proposed for this trim adjustment, and these are very effective.

However, when the trim adjustment is employed, particularly when accomplished by a servomotor or the like, it is desirable if the operator is provided with some form of indicator that will indicate the trim adjusted position of the discharge nozzle. This permits the operator to determine what setting offers optimum performance and return to that setting if he desires. However, the previously proposed types of trim indicators have been generally mechanically operated and have not been particularly satisfactory for reasons which may be understood by reference to FIGS. 1 and 2, which show two different types of prior art mechanical type of indicators.

Referring first to FIG. 1, this figure merely shows the indicator, the servomotor, and its connection to a wire actuator, indicated generally by the reference numeral 11. The wire actuator is connected to the discharge trim adjusting nozzle in a manner which will become apparent in conjunction with the description of the preferred embodiment of the invention, as shown in FIG. 3.

A servomotor, indicated generally by the reference numeral 12, which in most prior art constructions comprises a reversible electric motor, has an output shaft 13 that is rotatable in opposite directions, as shown by the arrow 14. A screw 15, similar to a lead screw, is driven by the output shaft 13 and receives a nut member 16 which may be a recirculating type ball nut or the like. This nut member 16 has a lug 17 to which one end of the wire element 18 of the wire actuator 11 is connected in a well-known manner.

As the electric motor 12 is energized to rotate in either of the directions indicated by the reference numeral 14, the recirculating ball nut 16, which is held against rotation in a suitable manner, will move axially along the screw 15 and effect reciprocation of the wire element 18 so as to effect trim adjustment of the discharge nozzle.

A pinion gear 19 is affixed to the end of the motor shaft 13 at the end of the screw 15 opposite the drive motor 12. This pinion gear 19 is enmeshed with an internal gear 21 of a ring gear 22, which is supported for rotation within any suitable manner. The ring gear 22 is disposed so that its exterior surface on which a legend 23 is placed will be visible from the operator. Thus he can determine the angular position of the motor shaft 14 and, accordingly, the trim adjusted position.

FIG. 2 shows another prior art type of construction which is somewhat simpler in configuration and in which the extending lug 17 passes through an opening 31 in a member of the body of the watercraft, adjacent which an indicia 32 is provided. As the shaft 15 rotates, the nut 16 will move in the directions of the arrow 33, and the lug 17 will traverse the slot 31. By its position an operator can determine the trim adjusted condition of the discharge nozzle.

It should be readily apparent from these constructions that it is necessary to put the servo drive motor 12 and the wire actuator 11 and its connection to the lug 17 in a position adjacent the rider's compartment and adjacent the outer surface of the body of the watercraft. This is not always desirable, and it does not permit a great deal of latitude in the placement of the mechanism. Also, the relationship of the motor 12 relative to the push-pull cable 11 is also compromised by the prior art types of indicators.

It is, therefore, a principal object of this invention to provide an improved trim position indicator for the trim adjustment mechanism of a jet propulsion unit for a watercraft.

It is a further object of this invention to provide an improved trim position indicator for a jet propulsion unit that can be placed at any desired location without its operation being compromised.

In connection with the trim adjustment of a watercraft, and particularly small personal-type watercraft normally powered by a jet propulsion unit, the trimming adjustment can be very important in the proper running and handling of the watercraft. If the trim adjustment is too high (water outlet lifted too high), then the watercraft can be subject to porpoising. If, on the other hand, the trim is too low, then the watercraft may not be stable, particularly when operating in a forward direction at high speeds. Providing fixed trim adjustments also is not necessarily practical because of the small size of these watercraft. Different weight operators, or a different number of passengers can significantly affect the optimum trim. Also the optimum trim can vary with various watercraft conditions in addition to its loading, such as speed.

It is, therefore, a still further principal object of this invention to provide an improved automatic trim adjusting mechanism for a jet-propelled watercraft.

It is a further object of this invention to provide an improved and simplified automatic trim adjustment mechanism for a personal watercraft powered by a jet propulsion unit.

If the watercraft is provided with a preset trim adjustment, as discussed above, the trim condition may not be optimum for the particular running condition of the watercraft and its loading. Therefore, there is an advantage in permitting the operator to select the trim condition under certain running conditions and having the trim adjustment mechanism automatically set the trim when operating at these conditions. For example, it may be desirable to permit the operator to set the trim at planing and also the trim when operating at a low speed non-planing condition.

It is, therefore, a still further object of this invention to provide an improved automatic trim adjustment mechanism for a personal watercraft powered by a jet propulsion unit wherein the operator can select desired trim conditions at certain running conditions, with the trim being set automatically thereafter in response to the preset conditions.

SUMMARY OF THE INVENTION

A first feature of this invention is adapted to be embodied in a trim position indicator for indicating the trim position of a discharge nozzle of a water jet propulsion unit, which discharge nozzle is movable generally about a horizontally disposed axis to a plurality of trim adjusted positions. A servomotor is provided for power adjustment of the discharge nozzle between its trim adjusted positions. An electrical detector detects the trim position of the discharge nozzle and outputs an electrical signal indicative of the trim position. An electrical indicator is provided for receiving the signal from the electrical detector and providing an indication to an operator of the trim position of the nozzle.

Another feature of the invention is adapted to be embodied in a watercraft powered by a jet propulsion unit having a discharge nozzle that is adjustable between a plurality of trim adjusted positions. A servomotor is provided for operating the nozzle between its trim adjusted position. A watercraft condition sensor is provided for sensing a watercraft condition. A control receives the signal from the watercraft condition sensor and actuators the servomotor to position the nozzle in the appropriate trim condition for the sensed watercraft condition.

DETAILED DESCRIPTION OF THE PREFERRED EMBODIMENTS OF THE INVENTION

Figure 1:
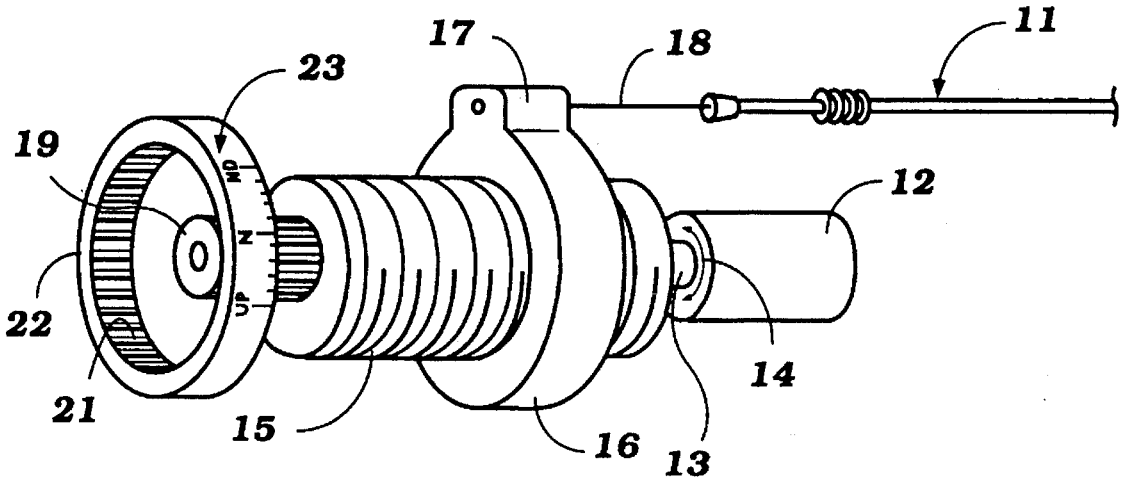
Figure 1 Prior Art
FIG. 1 is a perspective view of a prior art type of servomotor and indicator mechanism for adjusting and displaying the trim of a watercraft jet propulsion discharge nozzle.
Figure 2:
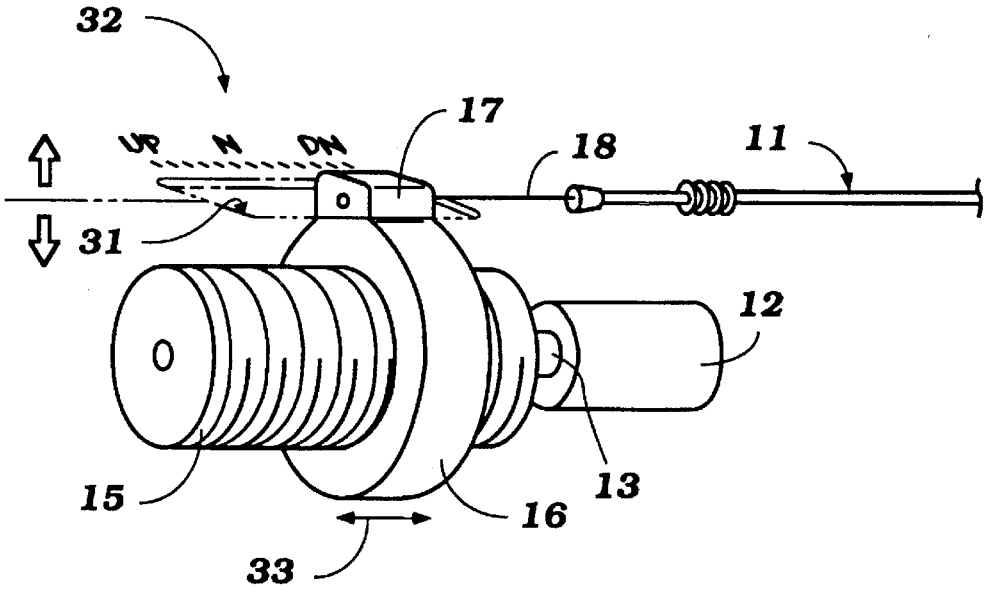
Figure 2 Prior Art
FIG. 2 is a perspective view of another prior art type of device.
Figure 3:
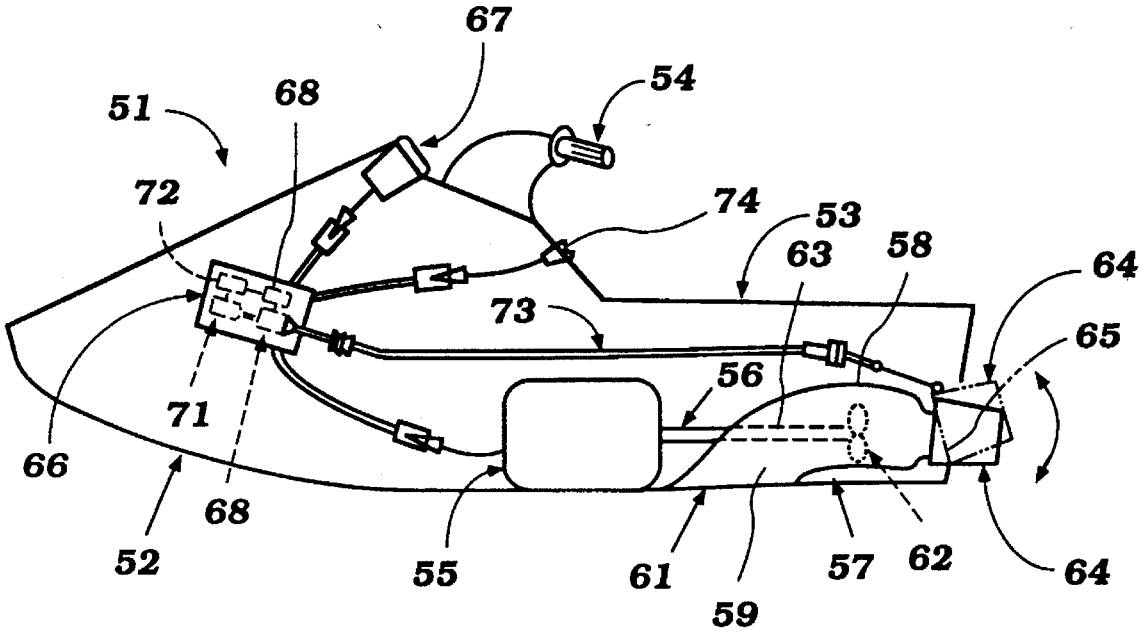
FIG. 3 is a side elevational view of a personal watercraft constructed in accordance with an embodiment of the invention.

Referring first to FIG. 3, this illustrates a small personal watercraft, indicated generally by the reference numeral 51, embodying the invention. The personal watercraft 51 is comprised of a hull 52 which has any desired configuration as utilized in this art. The watercraft hull 52 includes a passenger's area 53 that may contain a seat that is adapted to accommodate one or more riders seated in straddle fashion. If more than one rider is accommodated, they are seated in tandem fashion. A control mast 54 is positioned forwardly of the seat 53 and is adapted to control the steering of the watercraft and other functions. Certain of these functions will be described later.

The hull 52 defines an engine compartment in which an internal combustion engine, indicated generally by the reference numeral 55, is positioned. Since the engine 55 may be of any type known in this art, it is merely shown in block form. The engine 55 drives an output shaft 56, which extends rearwardly through a bulkhead at the forward portion .of a tunnel formed in the underside of the hull to drive a jet propulsion unit 57 positioned there.

The jet propulsion unit 57 has an outer housing 58 that defines a water inlet portion 59 having a downwardly facing water inlet opening 61 which registers with a corresponding opening formed in the underside of the hull 52 so that water may be drawn into the jet propulsion unit 57.

An impeller 62 is affixed to an impeller shaft 63 which is coupled to the drive shaft 56 for operating the jet propulsion unit 57. Water is discharged from the unit rearwardly to provide a forward propulsion force through a discharge nozzle 63. A steering and trim nozzle 64 is mounted on the discharge nozzle 63 for steering movement about a vertically extending steering axis. Motion about this axis is controlled by the control mast 54 in a manner well known in this art. In addition, the steering nozzle 64 is supported for pivotal movement about a transverse horizontally extending trim axis 65 for movement between a fully trimmed down position, as shown in solid lines in FIG. 3, and a fully trimmed up position, as shown in phantom lines in this figure.

A servo and control mechanism, indicated generally by the reference numeral 66, is provided for controlling the trim position of the discharge nozzle 64 and also for providing an indication of the adjusted trim condition to the operator by a trim position indicator 67 which is mounted in proximity to the control mast 54. The indicator 67 is an electrically operated device and receives a signal from a trim position sensor 68 which is a portion of the servo and control unit 66.

The sensor 68 is associated with a motion translating mechanism 69 of the type previously described and which is operated by an electrically driven servomotor 71. The servomotor 71 is controlled by a controller 72 which either processes a manually controlled signal or an automatically controlled signal to the servomotor 71 for trimming it in the appropriate direction and amount to position the discharge nozzle 64 as required. The motion translating mechanism 69 is coupled to the discharge nozzle 64 through a bedouin wire actuator, indicated generally by the reference numeral 73.

Finally, the system includes a manually operated trim switch 74 which may be a toggle type of switch. There is further provided a position selector or preset (PS) switch that the operator can utilize to send a control signal to memorize a trim condition, as will be described later by reference to the control routine of FIGS. 9–11 and the block diagram of the components shown in FIG. 8.

Figure 4:
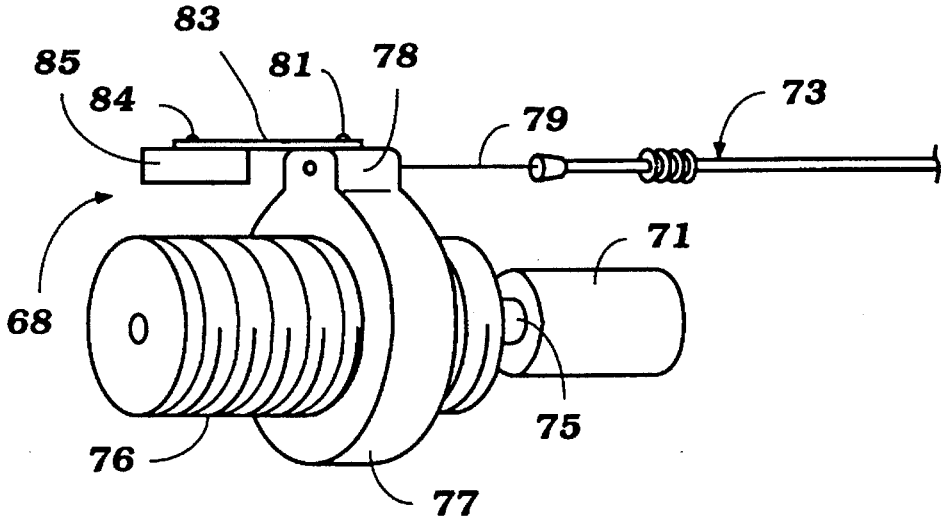
FIG. 4 is a perspective view, in part similar to FIGS. 1 and 2, and shows a first embodiment of trim position sensor constructed in accordance with the invention.
Figure 5:
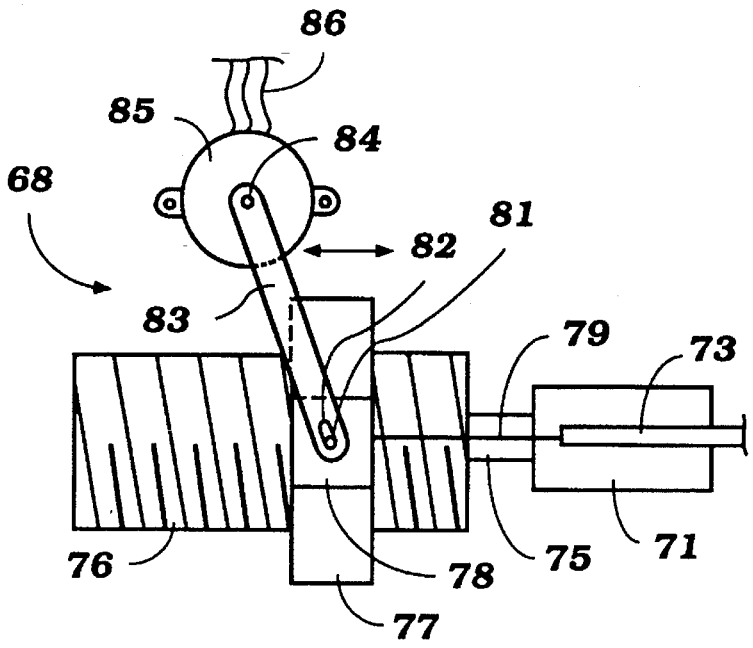
FIG. 5 is a top plan view of the trim position sensor in FIG. 4.

The trim position sensor 68 of this embodiment is illustrated in FIGS. 4 and 5. As has been noted, the mechanism for coupling the servomotor 71 to the wire actuator 73 is of the type normally utilized in this art. To this end, the servomotor 71 drives a shaft 75 to which is affixed a screw shaft 76. The screw shaft 76 cooperates with a nut, which may be of the recirculating ball type, indicated by the reference numeral 77. The nut 77 has a lug 78 to which the wire 79 of the wire actuator 73 is connected in a well-known manner.

The lug 78 further carries a pin 81 that is received in a slot 82 formed at one end of a wiper arm 83. The wiper arm 83 is connected to the shaft 84 of a potentiometer 85, and thus varies the resistance of the potentiometer 85 in response to the position of the recirculating ball nut 77 on the screw 76 and, accordingly, the trim adjusted position of the discharge nozzle 64. Electrical conductors 86 receive a fixed voltage and transmit the signal of resistance from the potentiometer 85 to the indicator 67 so as to provide the desired indication of the angle of the discharge nozzle 64, as is well known with such types of indicators.

Figure 6:
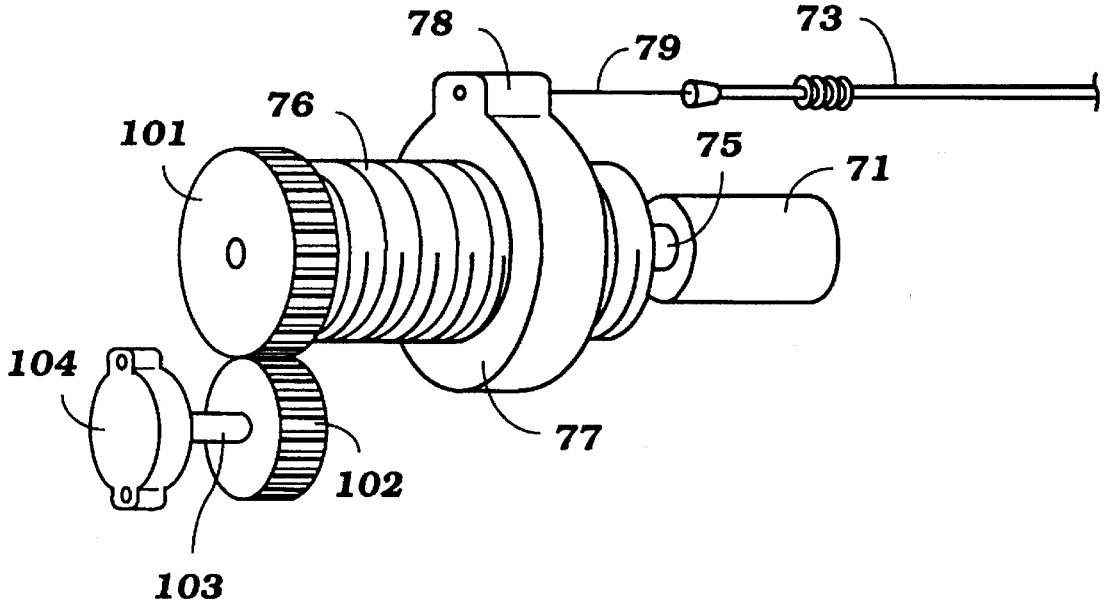
FIG. 6 is a perspective view, in part similar to FIG. 4, and shows a another embodiment of trim position sensor.

FIG. 6 shows another embodiment of electrical trim condition indicator, and since this indicator functions with the same servo mechanism as previously described, similar components have been identified by the same reference numerals and will not be described again. In this embodiment, the motor shaft 75 and screw 76 have affixed to them a spur gear 101. This spur gear 101 is enmeshed with a further spur gear 102 that is connected to a shaft 103 of a potentiometer 104. The output signal from the potentiometer 104 is transmitted to the indicator 67, as aforedescribed.

Figure 7:
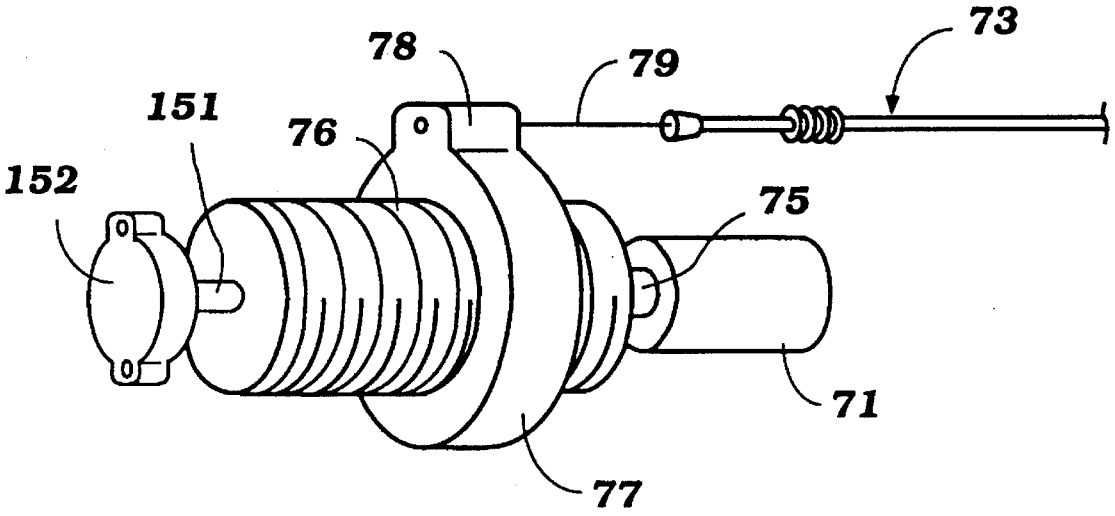
FIG. 7 is a perspective view, in part similar to FIGS. 4 and 6, and shows yet another embodiment of trim position sensor.

A further embodiment of the indicator is depicted in FIG. 7, and again the drive mechanism for the discharge nozzle is the same, and hence the same identifying reference numerals have been employed. In this embodiment, the motor drive shaft 75 and screw shaft 76 are directly affixed to a shaft 151 of a potentiometer 152. The potentiometer 152 provides a signal indicative of the trim adjusted position of the nozzle 64. This is displayed on the indicator 67.

Figure 8:
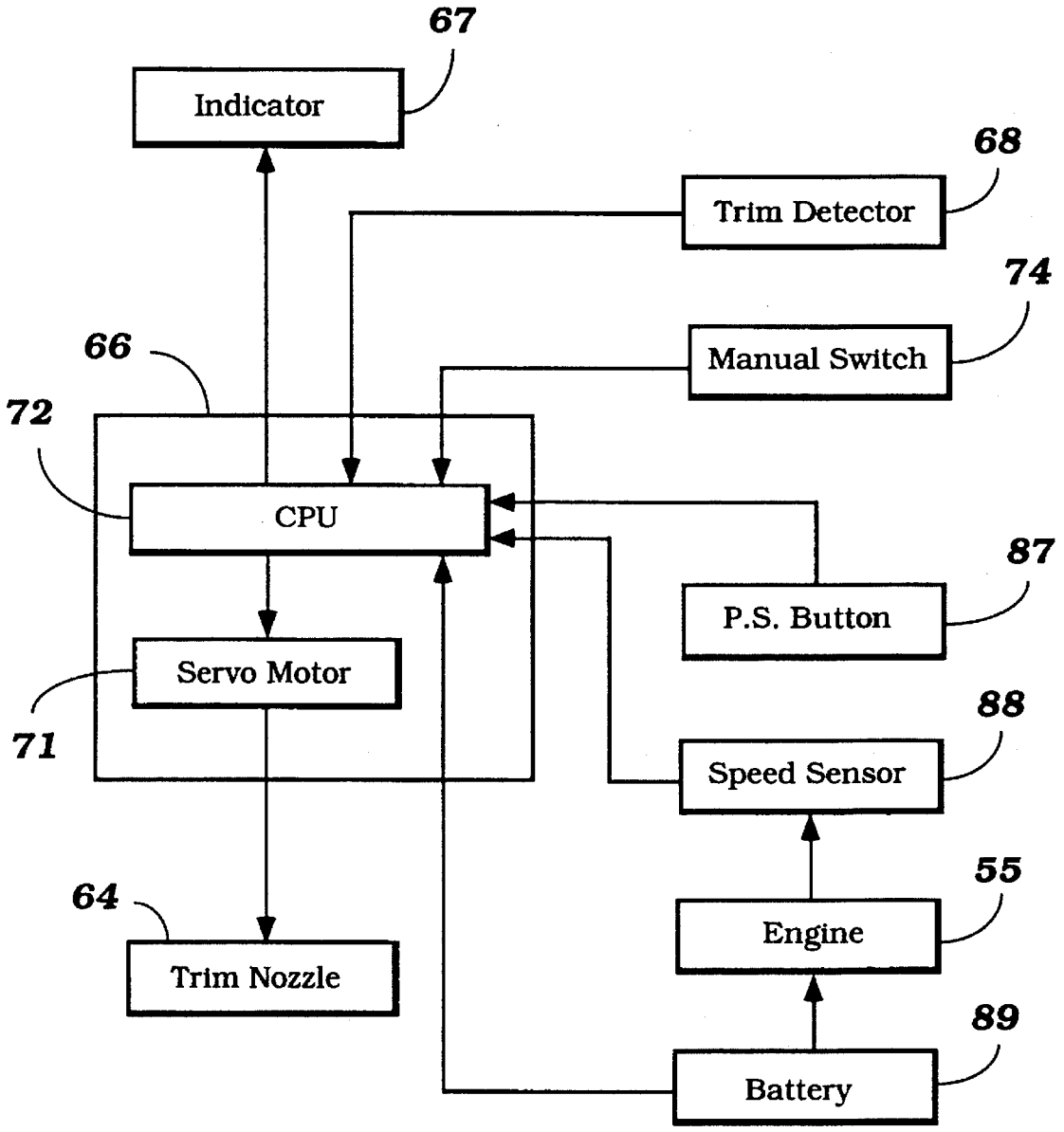
FIG. 8 is a block diagram showing the components of the automatic trim adjusting mechanism constructed in accordance with the invention and their interrelationship.

The components of the automatic trim control and their interrelationship are illustrated in FIG. 8 in block form. In addition to those components previously described and numbered, the preset (PS) switch is shown in this figure and is identified by the reference numeral 87. As previously noted, the operator uses this switch to set the preselected maximum and minimum automatic trim conditions depending upon watercraft speed conditions, these being either a low speed condition or a high speed planing condition.

There is also provided a vessel condition sensor that provides a vessel condition which may vary and which will call for varying trim positions of the nozzle 64 as it varies. In the illustrated embodiment, the vessel condition is the speed of the vessel, and this is determined by a speed sensor, indicated by the reference numeral 88. In the specific example illustrated, the speed sensor 88 actually measures the rotational speed of the engine 55 as this is a fairly accurate indication of vessel speed under most normal conditions.

Finally, the system includes a battery 89 which is charged by the engine 55, and specifically its magneto generator, and which provides electrical power to the various components for their operation. The trim detector 68, manual switch 74, PS button 87, and speed sensor 88 all output the signals of their conditions to a controller or CPU 72, which forms a portion of the servo control 66 previously referred to.

The CPU 72 outputs a driver signal to the indicator 68 for indicating to the operator the trim position of the discharge nozzle 64. It also controls the servomotor 71 in response to either an automatic trim control program or the manual input from the manual switch 64 in accordance with the control routine, which will now be described by reference to FIGS. 9–11.

Before addressing specifically the details of the control routine, it is to be understood that the system continuously monitors the condition of the manual trim switch 74 and also the condition of the preset switch 87. If both switches are actuated at the same time, then the system memorizes a new trim extreme position value. If only the manual switch is actuated, then either automatic or manual trim up or trim down is activated depending on the speed.

Figure 9:
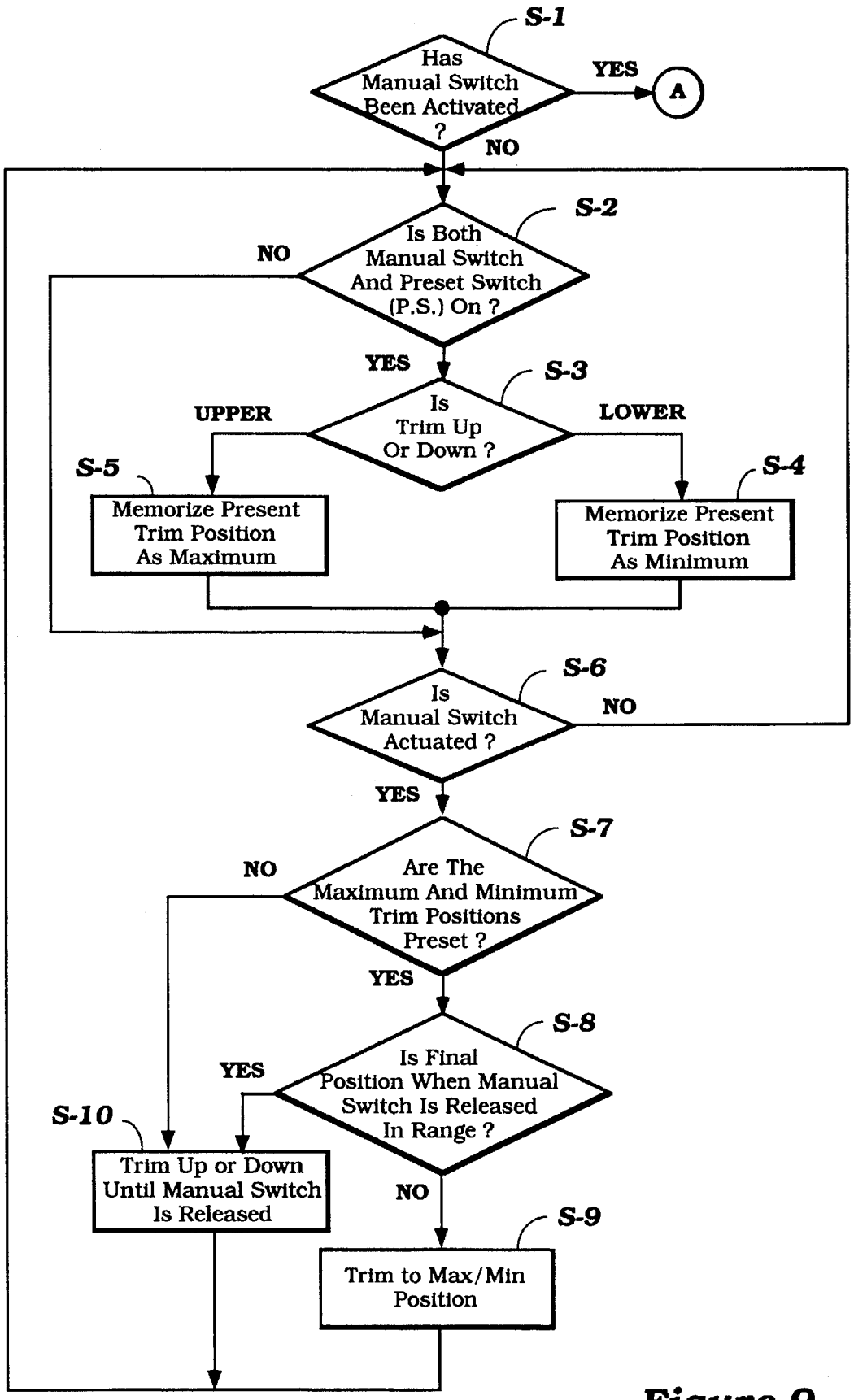
FIG. 9 is a block diagram showing a portion of the control routine associated with the automatic trim adjustment.

Referring first to the portion of the control routine shown in FIG. 9, at the step S1, the CPU 72 reads to determine if the manual switch has been activated. If it has, the program moves to the control routine shown in FIG. 10.

If, however, the manual switch is determined to have not been activated at the step S1, the program moves to the step S2 to continue to read the condition of the manual switch 74 and the preset switch 87. If both switches are then pressed at this time, the program moves to the step S3 to determine from the position of the trim angle sensor 68 whether the nozzle 64 is above or below the neutral position of this nozzle. If the nozzle is below the neutral position, the program moves to the step S4 to memorize the present trim position as the minimum trim angle. This decision is made because of the fact that it is assumed that the nozzle has been trimmed down from its position and that the operator wishes to select this new trim down position as the minimum trim down position, since the operator has pushed the preset button (PS) 87.

If, however, at the step S3 it is determined that the trim nozzle 64 is above the neutral position, the program then moves to the step S5. At this step, it is assumed that the operator is calling for the setting of a new maximum trim up position, and this position is then memorized in the CPU 72 as the new maximum trim up position.

If at the step S2 both the manual and preset switches have not been turned on or after the completion of the steps S4 and S5, the program moves to the step S6 to continue to monitor the condition of the manual switch 74. If it is not activated at this time, the program repeats back to the step S2.

If, however, at the step S6 the manual switch 74 for manual trim control has been activated, the program then moves to the step S7 so as to determine if maximum and minimum trim positions have been preset. It should be noted that at this time, since only the manual switch is being activated, it is assumed that the operator is calling for a manual trim adjustment.

If at the step S7 the maximum and minimum trim positions have been preset, the program moves to the step S8 and continues to read the condition until the manual switch is released. At this time it is determined if the manual position which the operator has called for is within the range of the preset ranges. If it is not and the operator has not pressed the PS switch to set a new maximum or minimum position, the program moves to the step S9, wherein the servomotor 71 is only activated for sufficient time to reach the minimum or maximum trim position, depending upon which operation (trim up or trim down) the operator has called for. Thus the operator may select manually the preset maximum or minimum trim conditions by pressing and holding the manual switch 74 in the correct direction.

If, however, at the step S7 the maximum and minimum trim positions have not been preset, or if at the step S8 the operator is calling for a manual trim adjustment within the range that has been preset, the program moves to the step S10 so as to operate the servomotor 71 sufficiently in either the trim up or trim down conditions, whichever has been called for, until the position called for by the operator has been reached. The program then repeats back to the step S2 at the completion of the steps S9 or S10.

Figure 10:
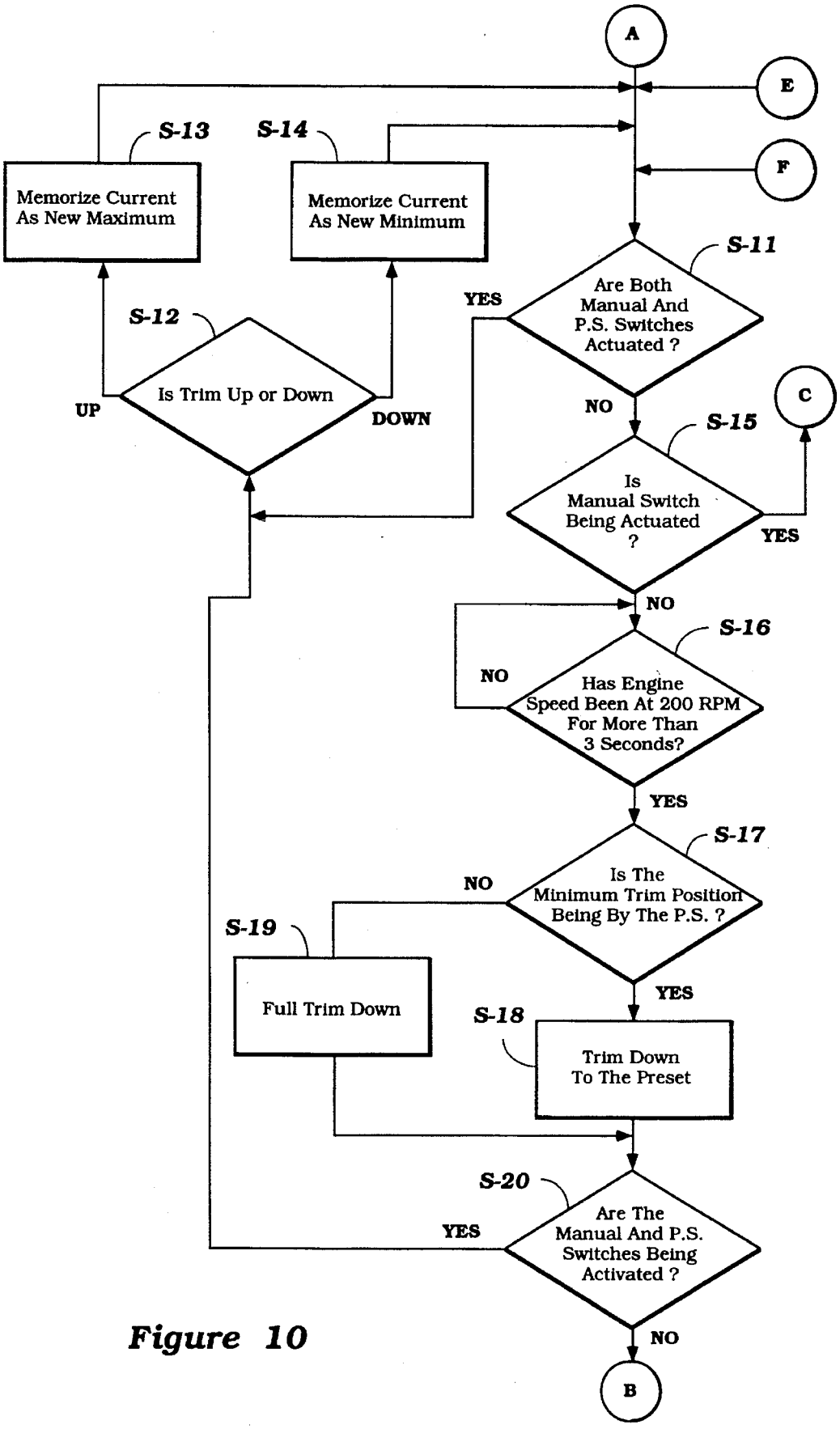
FIG. 10 is a block diagram of another portion of the automatic trim adjusting control routine.

Referring now to FIG. 10, this shows the control routine when the program has at the step S1 determined that the manual switch is being actuated and also shows how the system operates to automatically trim fully the preset maximum trim when the speed is at or below a predetermined relatively low speed, such as 2,000 rpm.

Referring now specifically to this figure, the program moves from the step S1 to the step S11 to determine if both the manual and the preset switches 74 and 87 are being activated. If they are, the program then moves to the step S12 to again determine if the trim nozzle to determine if it is in an up or a down position from the neutral position similar to the step S3 in the control routine of FIG. 9. If the nozzle condition is up from neutral, then the program moves to the step S13 so as to memorize the current nozzle position as the new desired maximum trim up condition.

If, however, at the step S12 it is determined that the nozzle is trimmed down, then the program moves to the step S14. At this step, the new trim down position of the nozzle 64 is preset in the memory as the new minimum position. At the completion of the steps S13 and S14, the program repeats back to the step S11.

If at the step S11 it is determined that the manual and the preset switches 74 and 87 are not both being activated, the program moves to the step S15. At this step it is determined if only the manual switch is being activated, and if so, the program moves to the control routine at the point C of FIG. 11.

If, however, at the step S15 it is determined that the manual switch is not being activated, the program moves to the step S16 to read the speed of the engine so as to set the trim condition automatically. If at the program step S16 the engine speed has not been at 2,000 rpm or below for more than three seconds, the program repeats.

If, however, it is determined at the step S16 that the engine speed has been 2,000 rpm or less for more than three seconds, then the program moves to the step S17. This time delay reduces the likelihood of hunting. At the step S17 it is determined whether or not the minimum trim position has been preset by activating the PS switch previously when the minimum desired trim position was reached. If it has been preset, then the program moves to the step S18 to trim down to the preset minimum trim condition.

If, however, at the step S17 it is determined that a minimum trim down position has not been previously set, then the program moves to the step S19 so as to effect full trim down operation.

At the completion of the steps S18 and S19, the program moves to the step S20 to determine if both the PS switches and manual switches are being activated. If they are, the program moves to the step S12 so as to set a new maximum or minimum preset position, as previously described.

Figure 11:
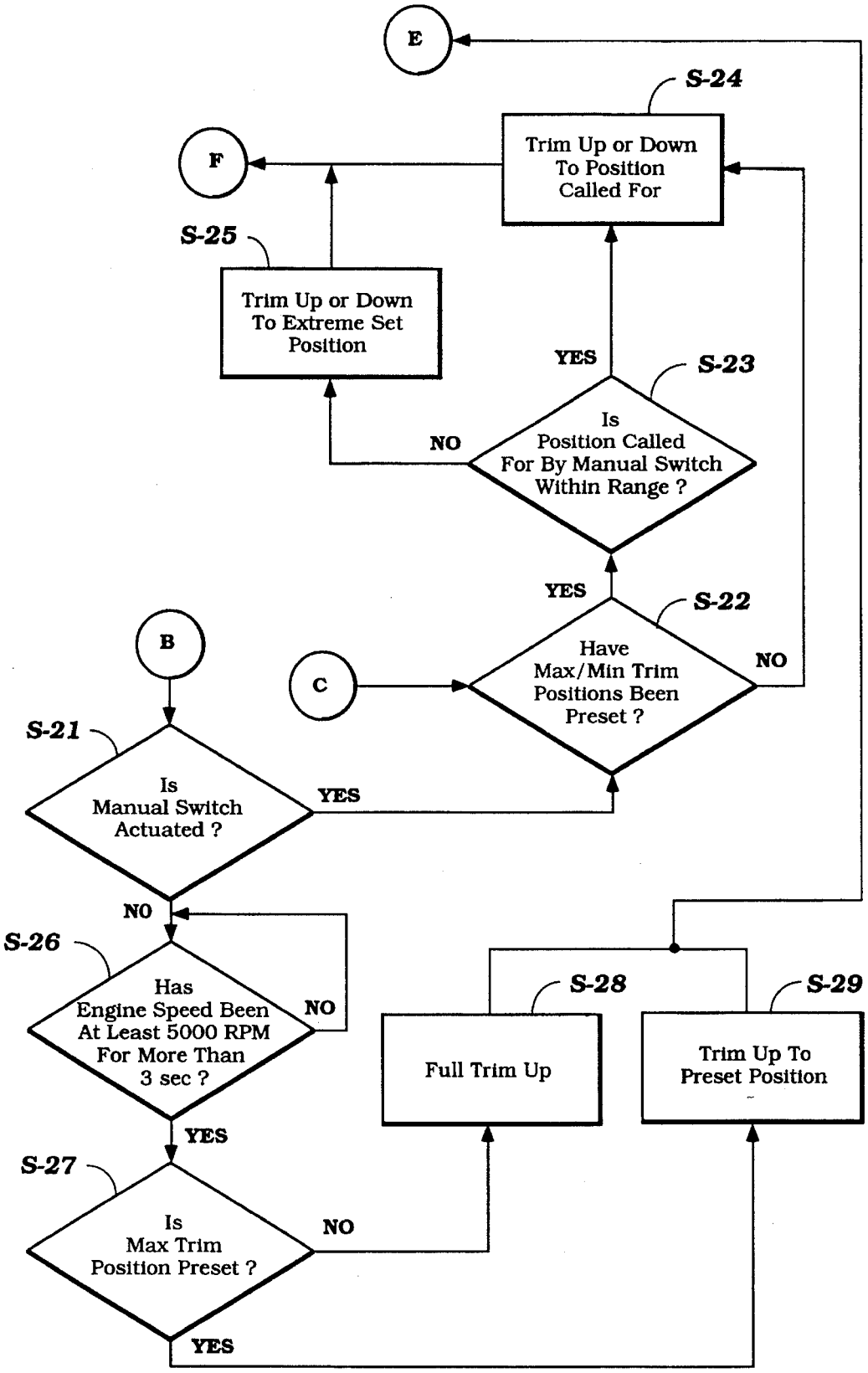
FIG. 11 is a further block diagram of the remaining portion of the automatic trim adjusting control routine.

If, however, the switches are not being activated at the step S20, then the program moves to the control routine of FIG. 11 at the point B.

The remaining portion of the control routine will now be described by particular reference to FIG. 11. This control routine basically is the control routine which is followed when automatic trim-up conditions exist. This routine is entered after the step S20 of FIG. 10 in the condition that the manual and PS switches are not being actuated. The program then continues on to determine if the manual switch is being actuated at the step S21. If it is, then the program moves to the step 22 to determine if the maximum and minimum trim positions have been preset. This is the same step to which the program shown in FIG. 10 moves if an affirmative answer is received to the same question at the step S15.

Therefore, if it is determined that the manual switch is being actuated, the program confirms that the maximum and minimum trim positions have been set.

If they have, the program moves to the step S23 so to determine if the manual switch is calling for a position within the range of positions preset between the maximum and minimum. If it is, the program moves to the step S24 so as to trim to the actual position being called for by the position when the manual switch was actuated.

In a like manner, if at the step S22 it is determined that the maximum and minimum trim positions have not been preset, then the program moves to the step S24 so as to also trim manually to the called for position.

If, however, at the step S23 it is determined that the position called for is outside of the preset range, then the program moves to the step S25 so as to trim up or down, depending upon which type of motion is being called for by the manual switch, to the preset trim position. At the completion of steps 24 or 25, the program repeats back to the step S11.

Assuming now that the manual switch has not been actuated at the step S21, the program moves to the step S26 to determine if the engine speed has been at or greater than a predetermined high speed, such as 5,000 rpm, for more than three seconds. The time period is, as before, set to reduce hunting. This is similar to the minimum setting condition of the step S17. If the engine speed has not been 5,000 rpm or more for the time period, the program repeats back.

If, however, the engine speed has been 5,000 rpm or more for more than three seconds, then the program moves to the step S27 so as to determine if the maximum trim position has been reset. If it has not, the program moves to the step S28 so as to accommodate automatic full trim up through the total range of movement of the discharge nozzle 64. If, however, the maximum trim position has been set when determined at the step S27, the program moves to the step S29 to automatically move to the maximum preset trim up position.

Regardless of whether the trim has been set at steps 28 or 29, the program then repeats back to the step S11.

It should be apparent from the foregoing description that the described construction provides not only a very effective trim position indicator that permits the servomotor and bedouin wire actuator to be positioned anywhere conveniently on the watercraft, but also that the automatic trim adjustment is extremely effective in permitting the operator to set the desired trim positions at two extreme running conditions and the trim will thereafter be automatically set when these conditions are reached. In addition, this permits the operator to maintain full attention toward operating the watercraft without having to divert significant amounts of his attention to the trim control. If desired a greater number of speed and trim settings may be programmed either by the operator or in the system by the manufacturer. Of course, the foregoing description is that of a preferred embodiment of the invention and various changes and modifications may be made without departing from the spirit and scope of the invention, as defined by the appended claims.

I claim:

1. A trim position indicator for indicating the trim position of a discharge nozzle of a watercraft jet propulsion unit which discharge nozzle is movable generally about a horizontally disposed axis to a plurality of trim adjusted positions, a servomotor, a screw driven by said servomotor, a nut received on said screw and fixed against rotation for axial movement of said nut upon rotation of said screw, said nut being connected to the discharge nozzle for controlling the position of said discharge nozzle upon axial movement of said nut along said screw for power adjustment of said discharge nozzle between said positions, an electrical detector comprised of a potentiometer having a wiper arm, said wiper arm having a pin and slot connection with said nut for detecting the trim position of said discharge nozzle and outputting an electrical trim position signal, and an electrical indicator receiving said trim position signal from said electrical detector and providing an indication to an operator of the trim position of said nozzle.

2. A trim position indicator as set forth in claim 1 in combination with a watercraft having a hull propelled by the jet propulsion unit and defining a rider's area, the servomotor being positioned within the hull and the indicator being positioned in proximity to the rider's area.

3. A trim position indicator as set forth in claim 2, further including means for sensing a watercraft condition and providing a watercraft condition signal to a controller for the servomotor, said electrical detector also providing an electrical signal to said controller for indicating the trim condition and whereby the controller affects operation of the servomotor to maintain the desired trim condition for the sensed watercraft condition.

4. A trim position indicator as set forth in claim 3 wherein the watercraft condition comprises speed.

5. A trim position indicator as set forth in claim 4 wherein the speed of the watercraft is measured by measuring the speed of an engine driving the jet propulsion unit.

6. A trim position indicator as set forth in claim 4, further including means for permitting the operator to set the desired trim condition at at least one speed.

7. A trim position indicator as set forth in claim 6 wherein the watercraft operator can set the desired trim position at a high speed and at a low speed.

8. A trim position indicator as set forth in claim 7 wherein the trim condition set by the operator can be varied by the operator at will.

9. A watercraft comprising a hull, a jet propulsion unit for propelling said hull and having a discharge nozzle moveable generally about a horizontally disposed axis to a plurality of trim adjusted positions, a servomotor for power adjustment of said discharge nozzle between said positions, a watercraft condition sensor, a controller for receiving signals from said watercraft condition sensor and actuating said servomotor for positioning said discharge nozzle in the desired position relative to the watercraft condition.

10. A trim position indicator as set forth in claim 9 wherein the watercraft condition comprises speed.

11. A trim position indicator as set forth in claim 10 wherein the speed of the watercraft is measured by measuring the speed of an engine driving the jet propulsion unit.

12. A trim position indicator as set forth in claim 10 wherein the trim condition is not adjusted automatically by the controller until the speed has stabilized for a predetermined amount of time.

13. A trim position indicator as set forth in claim 12, further including means for permitting the operator to set the desired trim condition at at least one speed.

14. A trim position indicator as set forth in claim 13 wherein the watercraft operator can set the desired trim position at a high speed and at a low speed.

15. A trim position indicator as set forth in claim 14 wherein the trim condition set by the operator can be varied by the operator at will.

16. A trim position indicator as set forth in claim 9, further including means for permitting the operator to set the desired trim condition at at least one speed.

17. A trim position indicator as set forth in claim 16 wherein the watercraft operator can set the desired trim position at a high speed and at a low speed.

18. A trim position indicator as set forth in claim 17 wherein the trim condition set by the operator can be varied by the operator at will.

* * * * *